US005884364A

United States Patent [19]

Domenig et al.

[11] Patent Number: 5,884,364

[45] Date of Patent: Mar. 23, 1999

[54] FURNITURE HINGE

[75] Inventors: Georg Domenig; Andreas Moser, both of Kernersville, N.C.

[73] Assignee: Grass America, Inc., Kernersville, N.C.

[21] Appl. No.: 890,156

[22] Filed: Jul. 9, 1997

[51] Int. Cl.[6] ..... E05D 7/04

[52] U.S. Cl. ..... 16/249

[58] Field of Search ..... 16/249

[56] References Cited

U.S. PATENT DOCUMENTS 5,375,297 12/1994 Lautenschlager et al. ..... 16/249

FOREIGN PATENT DOCUMENTS 2232728 1/1974 Germany ..... 16/249
3502468 7/1986 Germany ..... 16/249
2185524 7/1987 United Kingdom ..... 16/249

*Primary Examiner*—Chuck Y. Mah
*Assistant Examiner*—Donald M. Gurley
*Attorney, Agent, or Firm*—John M. Harrington; Kilpatrick & Stockton LLP

[57] ABSTRACT

A hinge for mounting a door on a frame of a furniture articles includes a first hinge member such as a hinge cup to be mounted to the door, a hinge arm connected at one end of the hinge arm to the hinge cup on a pivot pin fixed in the hinge cup, and a second hinge member in the form of a hinge plate disposed on the other end of the hinge arm. The hinge plate includes an elongate opening with a centrally disposed first section and adjacent sections communicating with the first section through first and second gap formed by projections extending from opposing sides of the elongate opening towards one another. A fastening screw can be premounted in the hinge arm plate by insertion into the first section of the elongate opening. The fastening screw is provided with a threaded section which engages the projection. The threaded section of the fastening screw and an unthreaded section are configured, respectively, to prevent passage of the fastening screw out of the first section of the elongate opening but to enable passage of the fastening screw for adjustment of the hinge arm plate on the frame member with a slight loosening of the fastening screw.

12 Claims, 2 Drawing Sheets

FURNITURE HINGE

BACKGROUND OF THE INVENTION

1. Field of the Invention.

The present invention relates to a hinge for mounting a door on a frame of a furniture article and more particularly to a hinge which enables pre-mounting a fastening screw in the hinge arm fastening plate and vertical adjustment of the mounted door relative to the supporting frame member.

2. Description of the Prior Art.

Various types of hinges for mounting a door on a furniture article which enable vertical adjustment of the mounted door relative to the supporting frame member have been used in the furniture and cabinet industries for many years. One such device is known from U.S. Pat. No. RE 34,995, and another such device is known from U.S. Pat. No. 5,375,297. Neither of such devices provides for pre-mounting a fastening screw in the hinge arm mounting plate, and the present invention addresses this need and interest.

SUMMARY OF THE INVENTION

The general purpose of the present invention, which will be described subsequently in greater detail, is to provide a new and improved hinge for mounting a door on a frame of a furniture article such as a cabinet or desk and with a hinge arm mounting plate which provides for pre-mounting a fastening screw in the hinge arm fastening plate, as well as vertical adjustment of the door relative to the supporting frame, that has all of the advantages of prior art hinges and none of the disadvantages. In order to attain this purpose, a representative embodiment of the present invention is illustrated in the drawings. The hinge of the present invention makes use of a first hinge member in the form of a hinge cup which is adapted to be mounted to one of a door or frame member, and preferably to be mounted to a door. The hinge of the present invention also includes a hinge arm connected at one end of the hinge arm to the first hinge member on a pivot pin or pivot axis fixed in the first hinge member, and a second hinge member in the form of a hinge plate which can either be connected to or formed as one piece with the hinge arm on the other end of the hinge arm. The hinge plate is adapted to be mounted to the other of the door or frame member, and preferably to be mounted to the frame member. The hinge serves to mount the door on the frame member for swinging relative to the frame member between an open position and a closed position. The first hinge member or hinge cup includes two radially extending mounting wings formed integrally with the hinge cup, through which mounting screws extend to fasten the hinge cup securely to the door.

The hinge plate includes an elongate opening which has opposing sides and which is adapted to receive a fastening screw for securing the hinge plate to the frame member. The elongate opening includes a substantially centrally disposed first section and an adjacent section communicating with the first section through a first gap. The first gap is formed by portions of opposing sides of the elongate opening which are configured as a first pair projections extending into the elongate opening towards one another. The first gap is defined between the first pair of projections which are spaced apart from one another by a distance that is less than the width of the first section of the elongate opening and also less than the width of the adjacent section of the elongate opening. Preferably, the elongate opening also includes another section adjacent the first section of the elongate opening which likewise communicates with the first section through a second gap. The second gap is formed between portions of the opposing sides of the elongate opening which are configured as a second pair of projections extending into the elongate opening towards one another. The second gap is defined between the second pair of projections which are spaced apart from one another by a distance which is less than the width of the first section and less than the width of the other ajacent section of the elongate opening.

A fastening screw can be pre-mounted in the hinge arm plate in a partly screwed in position before the hinge arm plate is mounted to the frame member. To enable such pre-mounting, the fastening screw, which is received in the elongate opening, is provided with a threaded section that is inserted in the first section of the elongate opening and which is cooperatively engaged by at least the first pair projection, and preferably engaged by both the first pair of projections and the second pair of projections. The threaded section includes a spiral thread having a plurality of thread crests that are spaced apart from one another by a distance which defines a pitch of the threaded section. The pitch of the threaded section is at least as great as the thickness of each one of the first pair of projections and at least as great as the thickness of the second pair of projections. Further, the threaded section has a major diameter, which is the diametric distance perpendicular to the central axis of the threaded section, measured between thread crests on opposing sides of the threaded section. The threaded section also has a minor diameter, which is the diametric distance perpendicular to the central axis of the threaded section, measured between the root portions on opposing sides of the thread section, and which is less than the major diameter of the threaded section. The first gap between the first pair projections, and the second gap between the second pair projections, are each at least as great as the minor diameter of the threaded section, but less than the major diameter of the threaded section. Accordingly, the fastening screw can be screwed into the first section with the thread crests on opposite sides of the threaded section cooperatively engaged by the first and second pairs of projections. Further, the fastening screw can be screwed in and out of the first section in a vertical direction, but so long as the thread crests are engaged by the first and second pairs of projections, the spiral thread of the threaded section cannot pass laterally from the first section either through the first gap or the second gap into the adjacent sections of the elongate opening.

The frame member can be provided with a pre-drilled fastening screw hole, and the hinge arm fastening plate can be attached to the frame member by simply screwing the fastening screw, pre-mounted in the first section of the elongate opening, into the pre-drilled hole. The fastening screw is provided with a head which has a diameter that is greater than the width of any section of the elongate opening to prevent passage of the head through the elongate opening. Thus, when the fastening screw is fully screwed in, the hinge arm plate is securely fastened to the frame member. Further, the second hinge member can be provided with one or more depending flanges which cooperate with the fasten screw to prevent swiveling of the hinge arm plate relative to the frame member. The elongate opening includes the sections which are adjacent and in communication with the central section of the elongate opening to permit vertical adjustment of the hinge arm plate relative to the frame member. In order to allow such adjustment, the fastening screw is provided with an unthreaded section which extends between the head and the threaded section a distance that is at least as great as the thickness of each one of the first and second pairs of projection. Further, the first pair of projections which define the first gap are spaced apart from one another by a distance that is at least as great as the diameter of the unthreaded neck section of the fastening screw, and the second pair of projections which define the second gap are likewise spaced apart from one another by a distance which is at least as great as the diameter of the unthreaded neck section of the fastening screw. Therefore, when the fastening screw is unscrewed and loosened only slightly from a fully screwed in position, the unthreaded section of the fastening screw is permitted to pass laterally from the first section through either of the first and second gaps into the adjacent sections of the elongate opening. Accordingly, with a slight loosening of the fastening screw, the hinge arm plate can be repositioned on the frame member in a vertical direction either upward or downward by a distance corresponding to the overall length of the elongate opening, and the fastening screw can be retightened after the hinge arm plate is repositioned.

The foregoing focusses on the more important features in the invention in order that the detailed description which follows may be better understood and in order that the present contribution to the art may be better appreciated. There are, of course, additional features of the invention which will be described hereinafter and which will form the subject matter of the claims appended hereto. It is to be understood that the invention is not limited in its application to the details of construction and to the arrangement of the components set forth in the following description and drawings. The invention is capable of other embodiments and of being practiced and of being carried out in various ways. It is to be further understood that the phraseology and terminology employed herein are for the purpose of description and are not to be recorded as limiting. Those skilled in the art will appreciate that the conception on which this disclosure is based may readily be used as a basis for designing the structures, methods and systems for carrying out the several purposes of the present invention. The claims are regarded as including such equivalent constructions so long as they do not depart from the spirit and scope of the present invention. From the foregoing summary, it is apparent that an object of the present invention is to provide a new and improved hinge for mounting a door on a frame of a furniture article such as a desk or cabinet which has all of the advantages, and more, of prior art devices, and none of the disadvantages.

It is another object of the present invention to provide a new and improved hinge for mounting a door on a frame of the furniture article that is more reliable and functional that those presently available.

Yet another object of the present invention is to provide a new and sophisticated, precision-made adjustable hinge that is compact, can operate reliably and efficiently, and yet enable renewed, preselected limited adjustments to be made to the mounted door with respect to the frame of the furniture article.

These, together with other objects of the present invention, along with the various features of novelty which characterize the invention, are pointed out with particularity in the claims annexed to and forming a part of this document.

For a better understanding of the invention, its operating advantages, and the specific objects attained by its uses, references should be made to the accompanying drawings in which like characters of reference designating like parts throughout the several views.

BRIEF DESCRIPTION OF THE DRAWINGS

This invention will be better understood and objects other than those set forth above, will become apparent when consideration is given to the following detailed description. Such description makes reference to the annexed drawings wherein.

DETAILED DESCRIPTION OF THE DRAWINGS

Figure 1:
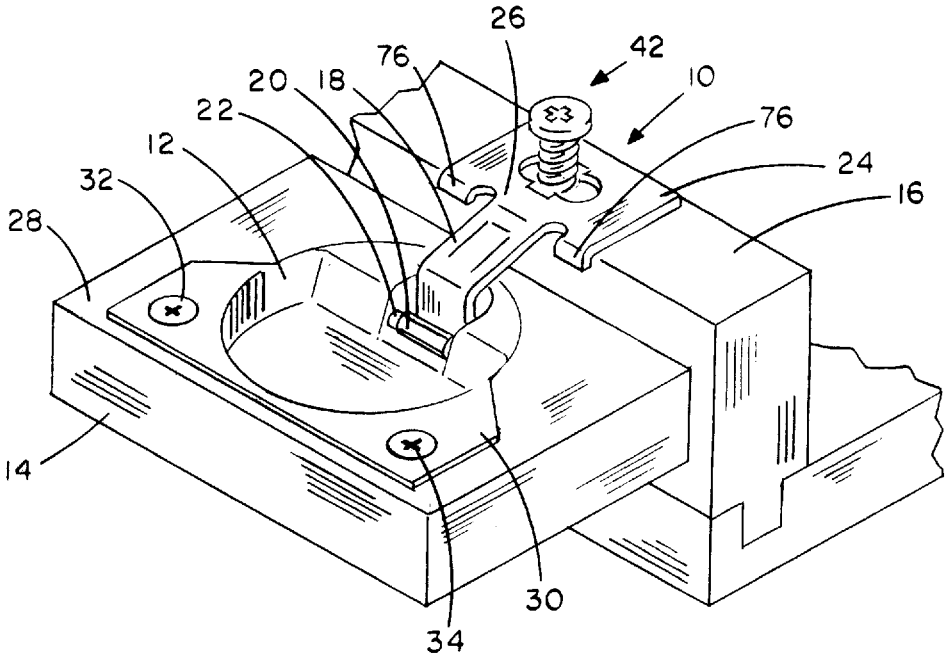
FIG. 1 is a perspective view of a hinge according to the present invention in a pre-mounted position on a door frame.

Referring to FIG. 1, the adjustable hinge, designated generally as 10, includes a first hinge member 12 in the form of a hinge cup adapted to be mounted to one of a door 14 or frame member 16 of a furniture article such as a cabinet or desk, and preferably to be mounted to door 14. Hinge 10 also includes a hinge arm 18 connected at one end 20 to first hinge member 12 on a pivot pin or pivot axis 22 fixed in hinge cup 12 and a second hinge member 24 in the form of hinge plate which can either be connected to or formed as one piece with hinge arm 18 on the other end 26 of hinge arm 18, and which is adapted to be mounted to the other of door 14 or frame member 16, and preferably to be mounted to frame member 16. Hinge 10 serves to mount door 14 on frame member 16 for swinging relative to frame member 16 between an open position as shown in FIG. 1 and a closed position (not shown). First hinge member 12 includes two radially extending mounting wings 28, 30, formed integrally with first hinge member 12, through which mounting screws 32, 34 extend to fasten first hinge member 12 securely to door 14.

Figure 2:
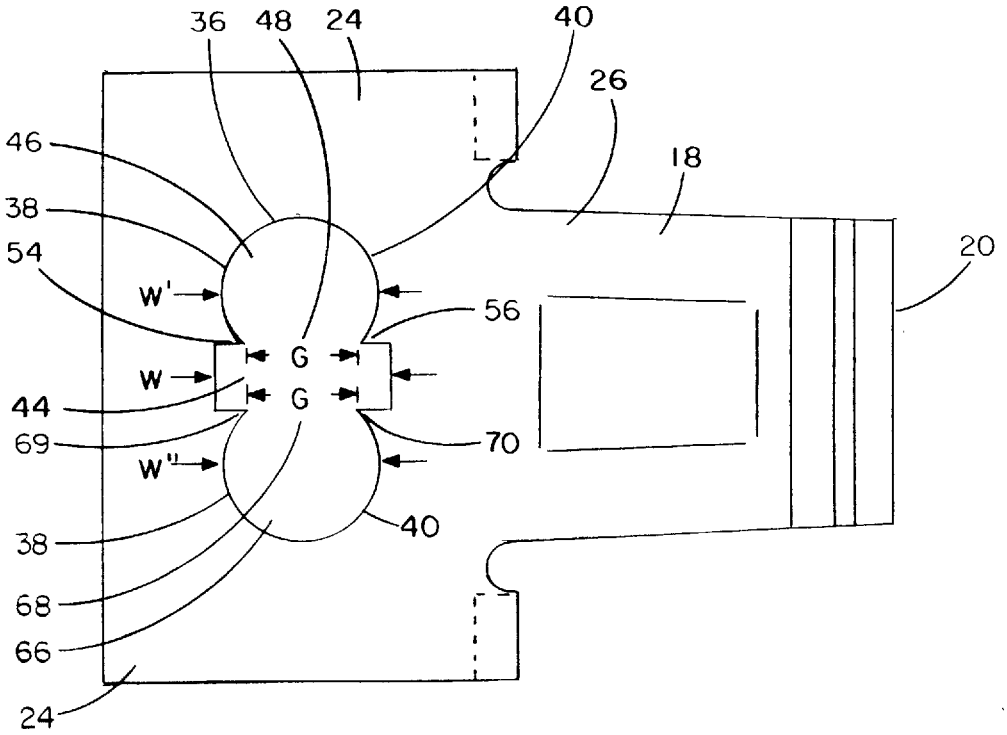
FIG. 2 is a top view of the hinge arm plate of the hinge of FIG. 1.

As shown in FIG. 2, second hinge member 24 includes an elongate opening 36, having opposing sides 38, 40, for receiving a fastening screw 42 for securing second hinge member 24 to frame member 16 as shown in FIG. 1. Elongate opening 36 includes a centrally disposed first section 44 and an adjacent section 46 communicating with first section 44 through a first gap 48. First gap 48 is formed by portions of opposing sides 38, 40 of elongate opening 36 configured as a first pair of projections 54, 56 extending into elongate opening 36 towards one another. First gap 48 is defined between projections 54, 56 which are spaced apart from one another by a distance "G", as shown in FIG. 2, which is less than width "W" of first section 44 and also less than width "W'" of section 46 of elongate opening 36. Preferably, elongate opening 36 also includes another section 66 adjacent first section 44 likewise communicating with first section 44 through a second gap 68. Second gap 68 is formed between portions of opposing sides 38, 40 of elongate opening 36 configured as a second pair of projections 69, 70 extending into elongate opening 36 towards one another. Second gap 68 is defined between projections 69, 70 which are spaced apart from one another by a distance "G'" which is less than width "W" of first section 44 and less than width "W"" of the other adjacent section 66 of elongate opening 36.

Figure 3:
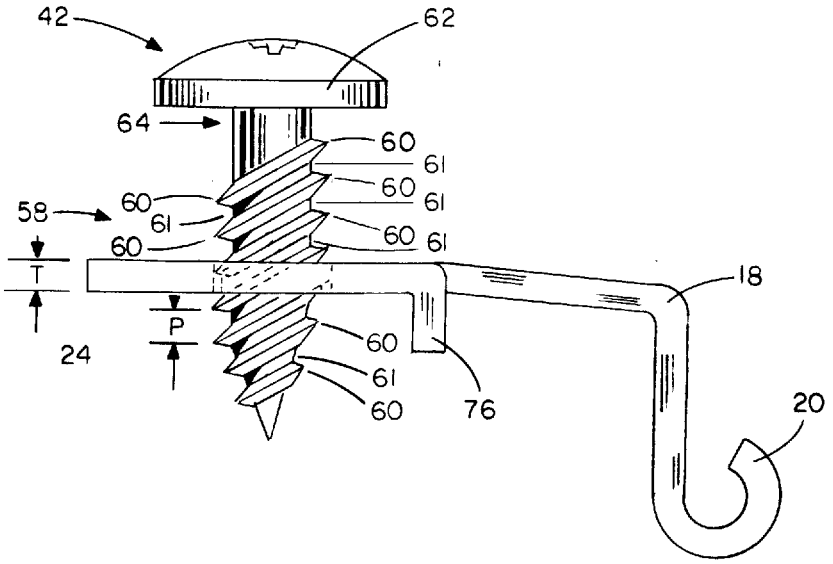
FIG. 3 is a cross section of the hinge arm plate of FIG. 1 with a pre-mounted screw.
Figure 4:
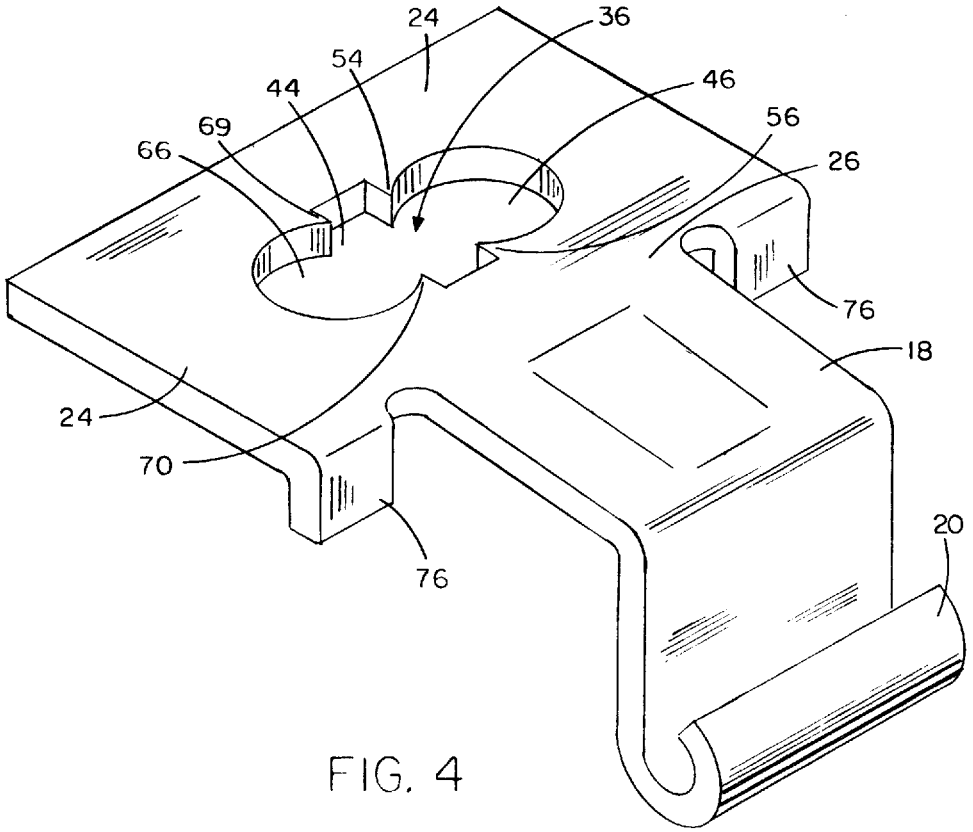
FIG. 4 is a perspective view of the hinge arm plate of the hinge of FIG. 1.

Pursuant to the present invention, a fastening screw 42 can be pre-mounted in second hinge member 24 in a partly screwed-in position, as shown in FIG. 3, before second hinge member 24 is mounted to frame member 16. To enable such pre-mounting, fastening screw 42, which is received in elongate opening 36, is provided with a threaded section 58 that is inserted in first section 44 of elongate opening 36 and cooperatively engaged by at least the first pair of projections 54, 56, and preferably by both the first pair of projections 54, 56 and the second pair of projections 69, 70. Threaded section 58 includes a spiral thread having a plurality of thread crests 60 that are spaced apart from one another by a distance "P", as shown in FIG. 3, which defines a pitch of threaded section 58. Pitch "P" is at least as great as a thickness "T" of each one of the first pair of projections 54, 56 and each one of the second pair of projections 69, 70.

Further, as shown in FIG. 3, threaded section 58 has a major diameter, which is the diametric distance perpendicular to the central axis of threaded section 58, measured between thread crests 60 on opposing sides of threaded section 58. Threaded section 58 also has a minor diameter, which is the diametric distance perpendicular to the central axis of threaded section 58, measured between root portions 61 on opposing sides of threaded section 58, and which is less than the major diameter of threaded section 58. First gap 48 between the first pair of projections 54, 56, and second gap 68 between the second pair of projections 69, 70, are each at least as great as the minor diameter, but less than the major diameter, of threaded section 58. Accordingly, fastening screw 42 can be screwed into first section 44 with thread crests 60 on opposite sides of threaded section 58 cooperatively engaged by the first and second pairs of projections 54, 56, and 69, 70. Further, fastening screw 42 can be screwed in and out of first section 44 in a vertical direction, but so long as thread crests 60 are engaged by the first and second pairs of projections 54, 64 and 69, 70, the spiral thread of threaded section 58 cannot pass laterally from first section 44 either through first gap 48 into adjacent section section 46 or through second gap 68 into adjacent section 66 of elongate opening 36.

Frame member 16 can be provided with a pre-drilled fastening screw hole (not shown), and second hinge member 24 can be attached to frame member 16 by simply screwing fastening screw 42, pre-mounted in first section 44 of elongate opening 46, into the pre-drilled hole. Fastening screw 42 is provided with a head 62 which has a diameter that is greater than the width of elongate opening 36 to prevent passage of head 62 through elongate opening 36. Thus, when fastening screw 42 if fully screwed in, second hinge member 24 is securely fastened to frame member 16. Further, second hinge member 24 can be provided with one or more depending flanges 76 which cooperate with fastening screw 42 to prevent swiveling of second hinge member 24 relative to frame member 16. Pursuant to the present invention, elongate opening 36 includes sections 46, 66, each adjacent and communicating with central section 44, to permit vertical adjustment of second hinge member 24 relative to frame member 16. In order to allow such adjustment, fastening screw 42 is provided with an unthreaded section 64, as shown in FIG. 3, extending between head 62 and threaded section 58 a distance that is at least as great as the thickness "T" of each one of the first and second pairs of projections 54, 56 and 69, 70. Further, projections 54, 56, defining first gap 48, are spaced apart from one another by a distance "G", and projections 69, 70, defining second gap 68 are spaced apart from one another by a distance "G'", each of which is at least as great as a diameter of unthreaded neck section 64 of fastening screw 42. Therefore, when fastening screw 42 is unscrewed and loosened only slightly from a fully screwed in position, unthreaded section 64 is permitted to pass laterally from first section 44 through either of first and second gaps 48 or 68 into adjacent sections 46 or 66 of elongate opening 36, respectively. Accordingly, with a slight loosening of fastening screw 42, second hinge member 24 can be repositioned on frame member 16 in a vertical direction either upward or downward by a distance corresponding to the entire length of elongate opening 36, and fastening screw 42 can retightened after second hinge member 24 is repositioned.

With respect to the descriptions set forth above, optimum dimensional relationship of parts of the invention (to include variations in size, materials, shape, form, function and manner of operation, assembly and use) are deemed readily apparent and obvious to those skilled in the art, and all equivalent relationships to those illustrated in the drawings and described in the specification are intended to be encompassed herein. The foregoing is considered as illustrative only of the principal of the invention. Since numerous modifications and changes will readily occur to those skilled in the art, it is not intended to limit the invention to the exact construction and operation shown and described, and all suitable modifications and equivalents falling within the scope of the appended claims are deemed within the present inventive concept.

What is claimed is:

1. A hinge for mounting a door on a frame of an article of furniture such as a cabinet or desk, comprising:

a first hinge member adapted to be mounted to one of a door and a frame;

a hinge arm pivoted to the first hinge member on a pivot axis;

a second hinge member connected to the hinge arm and being adapted to be mounted to the other of the door and frame;

an elongated opening formed in the second hinge member, the elongated opening having opposing sides and being adapted to receive a fastening screw;

said elongated opening including a first section and at least one section adjacent and communicating with the first section through a first gap formed between portions of the opposing sides of the elongated opening which, said portions being spaced apart from one another by a distance which is less than a width of the first section and less than a width of said at least one section adjacent and communicating with the first section of the elongated opening;

said portions of the opposing sides of the elongated opening being defined as a first pair of projections formed on said opposing sides and extending into the elongated opening towards one another in substantially coplanar relationship with portions of the second hinge member adjacent the opposing sides of the elongated opening;

a fastening screw received in said elongated opening the fastening screw having a threaded section cooperatively engaged by at least said first pair of projections;

said fastening screw having a head and an unthreaded neck section extending between the head and the threaded section a distance that is at least as great as said thickness of each one of said first pair of projections;

said fastening screw head having a diameter that is greater than said width of said first section and greater than a width of said at least one section adjacent and communicating with the first section; and said fastening screw having a flat bottom side adjacent the unthreaded neck section.

2. A hinge according to claim 1, said fastening screw threaded section having a plurality of thread crests spaced from one another by a distance which defines a pitch of the threaded section that is at least as great as a thickness of each one of said first pair of projections.

3. A hinge according to claim 2, said fastening screw threaded section having a major diameter and a minor diameter, and said first gap being at least as great as the minor diameter of the threaded section and less than the major diameter of the threaded section.

4. A hinge according to claim 3, said first pair of projections being spaced apart from one another by a distance that is at least as great as a diameter of the unthreaded neck section of the fastening screw.

5. A hinge accordng to claim 4, said elongate opening including another section adjacent and communicating with said first section through a second gap formed between a second pair of projections formed on said opposing sides of the elongate opening and extending into the elongate opening, which second pair of projections are spaced apart from one another by a distance defining said second gap that is less than said width of the first section and less than a width of said other section adjacent and communicating with the first section.

6. A hinge according to claim 5, said threaded section of the fastening screw being cooperatively engaged by said first and second pairs of projections.

7. A hinge according to claim 6, said pitch of the threaded section of the fastening screw being at least as great as a thickness of each one of said second pair of projections.

8. A hinge according to claim 7, said second gap being at least as great as said minor diameter of the threaded section of the fastening screw and less than said major diameter of the threaded section of the fastening screw.

9. A hinge according to claim 8, said unthreaded neck section of the fastening screw extending a distance that is at least as great as said thickness of each one of the second pair of projections.

10. A hinge according to claim 9, said second gap being at least as great as said diameter of the unthreaded neck section of the fastening screw.

11. A hinge according to claim 10, said diameter of the fastening screw head being greater than the width of said other section adjacent and communicating with the first section of the elongate opening.

12. A hinge for mounting a door on a cabinet, comprising:

a first hinge member adapted to be mounted to one of a door and a cabinet;

a second hinge member pivoted to the first hinge member and adapted to be mounted to the other of the door and the cabinet;

one of the first and second hinge members comprising a hinge plate having portions defining an elongated opening with opposing sides and a predetermined width;

first and second pairs of opposed projections formed on the opposite sides of the opening and extending into the opening in substantially coplanar relationship with portions of the hinge plate adjacent the opposing sides of the opening;

a headed fastening screw engaged by said first and second pairs of projections, the fastening screw head having a flat bottom side and a width that is greater than the width of the elongated opening.

* * * * *